United States Patent [19]

Albarello

[11] 4,443,857

[45] Apr. 17, 1984

[54] PROCESS FOR DETECTING THE MELODY FREQUENCY IN A SPEECH SIGNAL AND A DEVICE FOR IMPLEMENTING SAME

[75] Inventor: Alain Albarello, Paris, France

[73] Assignee: Thomson-CSF, Paris, France

[21] Appl. No.: 318,135

[22] Filed: Nov. 4, 1981

[30] Foreign Application Priority Data

Nov. 7, 1980 [FR] France ..... 80 23881

[51] Int. Cl.[3] ..... G10L 1/00

[52] U.S. Cl. ..... 364/513.5; 381/49

[58] Field of Search ..... 179/1 SC, 1 SA; 364/513.5; 381/38, 49

[56] References Cited

U.S. PATENT DOCUMENTS

| | | | |
|---|---|---|---|
| 3,573,612 | 4/1971 | Scarr | 179/1 SC |
| 4,001,505 | 1/1977 | Araseki et al. | 179/1 SC |
| 4,015,088 | 3/1977 | Dubnowski et al. | 179/1 SC |
| 4,061,878 | 12/1977 | Adoul et al. | 179/1 SC |

OTHER PUBLICATIONS

Rabiner, et al., "A Comparative Performance Study . . . ", IEEE Trans. on Acoustics, etc., Oct. 1976.

*Primary Examiner*—E. S. Kemeny

*Attorney, Agent, or Firm*—Oblon, Fisher, Spivak, McClelland & Maier

[57] ABSTRACT

The process uses a set of data characteristic of the speech signal, supplied by processing circuits: measurements of the time intervals between zero crossovers and measurements of the energy in the half-waves of this signal. The test procedure implemented by a microprocessor selects the half-waves whose energies exceed thresholds characterizing pitch period beginnings. These thresholds are predetermined for the first two successive sums selected, then depend on the energy values of the preceding half-waves selected differently according as to whether the voiced character of the signal is acquired or not. Complementary tests are used for minimizing detection errors.

10 Claims, 10 Drawing Figures

TO TEST I
START TEST II
initial = initial + 1
atest=0
t12p=0
t12n=0
i = i+1
READ { ai ti
atest=2
ai>0
SIGN ALTERNATION VERIFICATION
SIGN ALTERNATION VERIFICATION
t12p = t12p+tp+tn
t12n = t12p+tp+tn
tp = ti
tn = ti
t12p<TM
t12n<TM
ai>S2p
ai<S2n
atest=3
atest=3
t12p=t12p+tp+tn
t12n=t12n+tp+tn
i = i+1 LIRE ti
i = i+1 LIRE ti
tn = ti
tp = ti
a2p = ai
a2n = ai
atest = atest+1
atest=4
|t12p-t12n|<tpn
END TEST II
TO 1 START TEST III

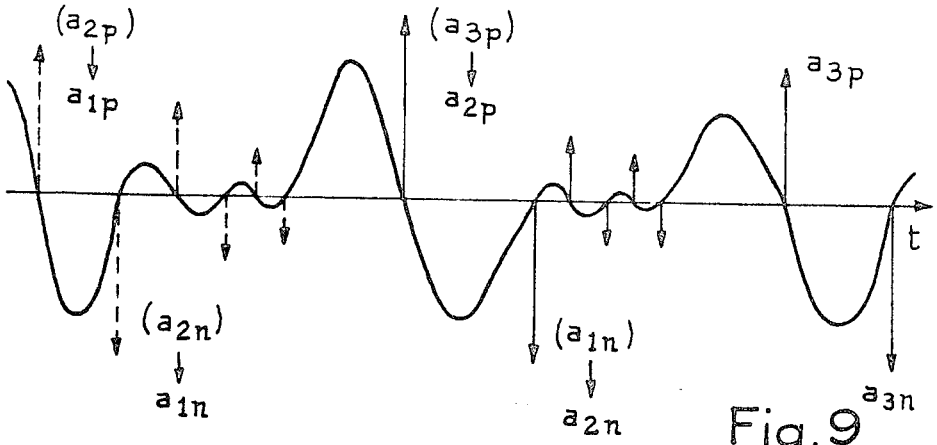
Fig. 9
Fig. 10
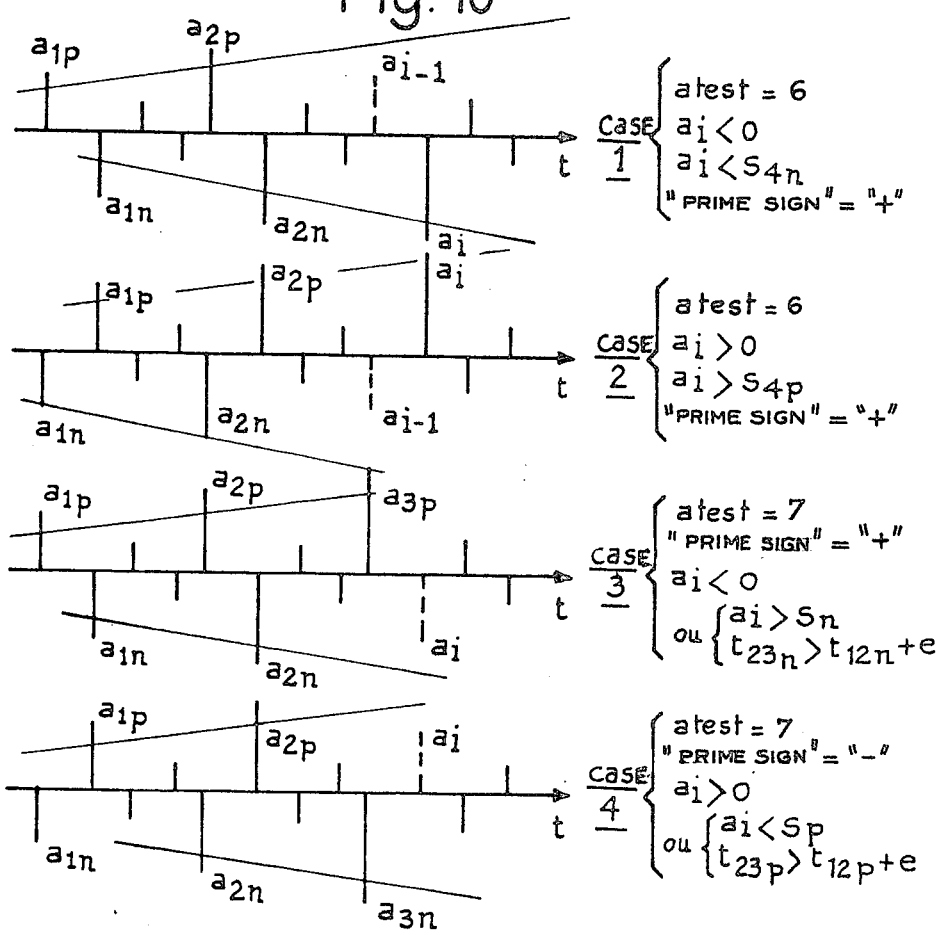

PROCESS FOR DETECTING THE MELODY FREQUENCY IN A SPEECH SIGNAL AND A DEVICE FOR IMPLEMENTING SAME

BACKGROUND OF THE INVENTION

The invention relates to the analysis of speech signals and more especially to a process for detecting the pitch frequency of voiced sounds in the speech signal and to a device for implementing this process.

In speech, the voiced sounds are formed of vowels or liquid or voiced consonants and possess very specific spectral properties which are not to be found in the unvoiced sounds formed by breathed consonants. These voiced sounds have generally a greater amplitude than the unvoiced sounds and a very marked periodicity in the speech signal. The value of the frequency corresponding to this periodicity (related to the vibration of the vocal cords) is the pitch frequency situated, depending on the person, between 60 and 300 Hz.

This pitch frequency is a fundamental parameter of speech which is evaluated in most vocoders, the quality of the detection of this frequency having a direct influence on the quality of the speech restored after decoding.

The analysis of the state of the art permits two classes of processes and devices for detecting the pitch frequency to be distinguished:

The first proceed by systematic analysis of the speech signal, spectrum analysis or self-correlation, and use generally a volume of calculations which is too great to lead to real-time realizations by means of relatively simple systems.

The second, of a time type, try to locate a periodicity directly in the time signal. They generally use a reduced set of data, for example the time intervals between zero crossovers (or between maximums of the signal), or counting the zero crossovers of the signal during a given time; the criteria of decision take into account the properties observed in the speech signals. The calculations are more reduced for this type of detection, but the corresponding detection devices do not perform very well in the presence of noise and during the voiced signal—unvoiced signal transitions. A process and a device for detecting the melody period using, as set of data, the measurements of the energy in the successive arches of the speech signal has also been described. This device benefits, with respect to the more current time-type devices, from a better immunity against noise and a more selective voicing criterion which limits false detections. However, the detection requires the signal to be chopped into frames of fixed length, the calculations for recognizing a voiced sound only being able to be effected with a lag of a frame. Furthermore, there exists a risk of detecting the double frequency of the pitch frequency for the criterion for avoiding such detection is only effective in the middle of a voiced segment. Finally, the chopping of the signal into frames of fixed lengths which are not related to the contents of the speech signal adversely affects the quality of the measurement, in particular during voiced signal—unvoiced signal transitions.

BRIEF SUMMARY OF THE INVENTION

The invention provides a process for the real-time detection of the melody frequency in speech, of the time type, using measurements of the energy between zero crossovers, as well as measurements of the time intervals between these zero crossovers. The process avoids false detections, in particular the detection of the double frequency, and good immunity against noise and, moreover, does not appreciably increase the complexity of the device for implementation thereof with respect to known devices.

According to the invention, a process for the real-time detection of the pitch frequency in speech, from a reduced set of data measured in this signal, is principally characterized in that this set is formed of measurements $a_i$ (i variable) of the energy in the successive half-waves of this signal and of measurements $t_i$ associated with the durations of these half-waves, and in that the test procedure used on this data comprises an acquisition phase during which a first test series confers, when it is verified, the acquired character under voicing and results in the calculation of a first pitch period value, and a holding phase during which a second test series confirms, when it is verified, the acquired character of the voicing and results in the updating of the value of the melody period, this second series of tests being repeated as long as the acquired character of the voicing is conserved and a new acquisition phase being initiated when the acquired character of the voicing is lost.

The invention also provides a device for implementing this process of melody frequency detection.

BRIEF DESCRIPTION OF THE DRAWINGS

The invention will be better understood and other characteristics will appear from the following description with reference to the accompanying figures.

FIG. 9 shows one example of a voiced signal segment during speech; and

FIG. 10 shows some particular configurations of the energy in the half-waves of the voiced signal.

DESCRIPTION OF THE PREFERRED EMBODIMENT

The process for detecting the melody frequency uses, for locating the presence of a voiced signal and for measuring the corresponding melody period, a reduced set of data formed in the following way: the speech signal is first of all filtered by a low-pass filter whose cut-off frequency is f=800 Hz; this filtered signal is then sampled. Then, from the filtered and sampled signal, the data useful for the detection is obtained by detection of the zero crossovers of this signal and "integration" between consecutive zero crossovers; the corresponding sums give an estimate of the energy in each positive or negative half-wave of the signal. The time intervals $t_i$ (i variable) between zero crossovers are stored in a first table and the corresponding sums $a_i$ are stored in a second table. These two tables are established in real time. Finally, from this reduced set of data, the discrimination between voiced and unvoiced segments of the signal is obtained by following different criteria depending on the phases: during the so-called "acquisition"

phase, the device follows a first test procedure in accordance with a first set of criteria, whereas during a second so-called "holding" phase, the device follows a second test procedre in accordance with a second set of criteria. When, during this holding phase, the test indicates that the voiced character of the signal is lost, a new acquisition phase begins.

During these procedures, additional protection tests are introduced for avoiding false detections.

Figure 1:
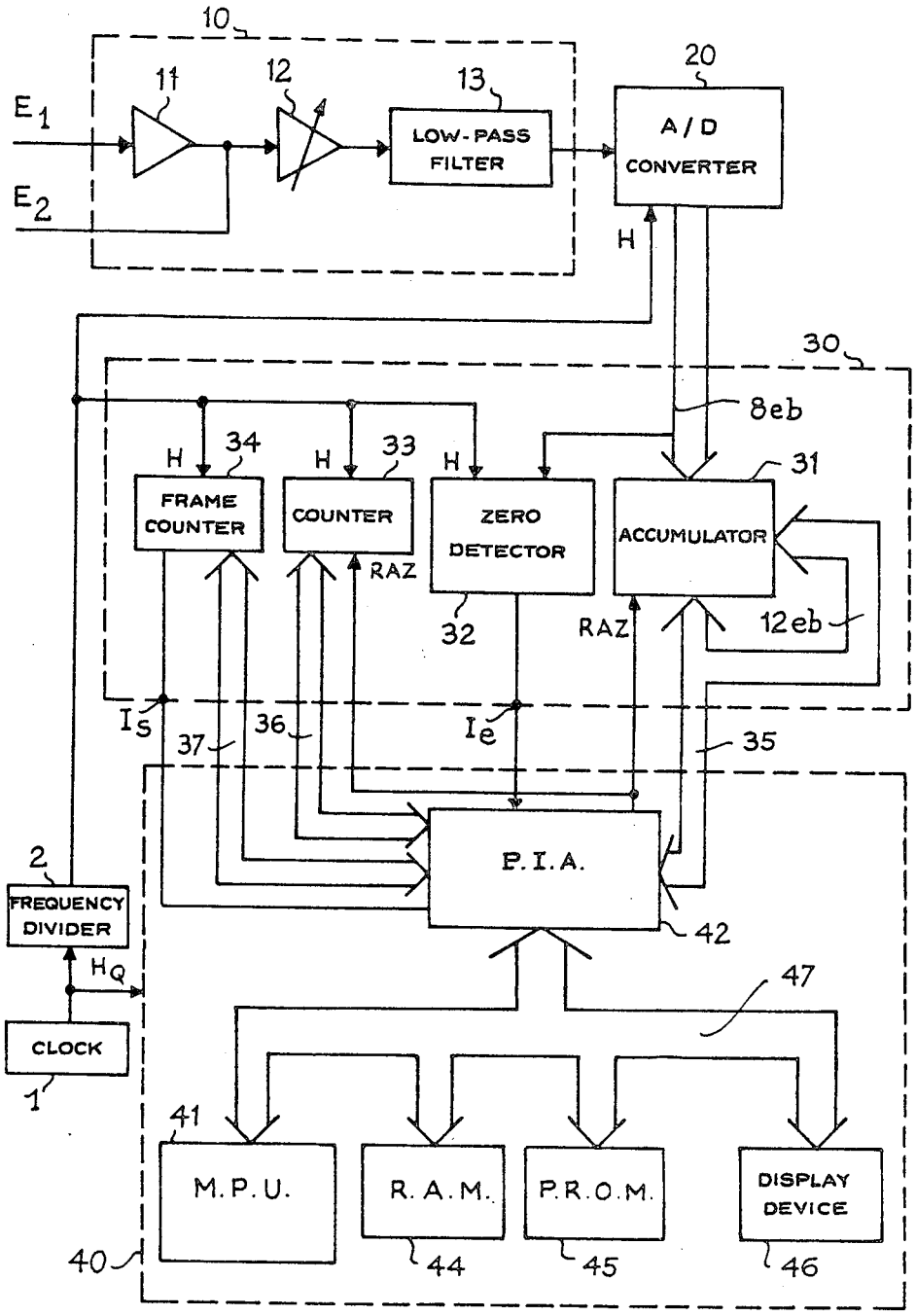
FIG. 1 is the diagram of the detection device of the invention.

The pitch frequency detection device for implementing the above very briefly described process is shown in FIG. 1. This device comprises an analog processing circuit 10 with two inputs, $E_1$ and $E_2$, respectively adapted for connection to a microphone and to the output amplifier of a line. This analog processing device comprises: an amplifier 11 whose input is connected to input $E_1$, a second, variable-gain, amplifier 12 whose input is connected to the output of amplifier 11, on the one hand, and directly to input $E_2$, on the other hand. This amplifier 12 has its output connected to the input of a low-pass filter 13 whose cut-off frequency is, as mentioned above, f=800 Hz. The output of the low-pass filter 13 is connected to the signal input of an analog-digital converter 20. This converter comprises moreover a clock input H fixing the frequency of the samples taken from the analog signal. This clock input is coupled to the output of a clock 1, delivering a signal at frequency $H_Q$, through a frequency divider 2 whose output delivers a clock signal H.

By way of example, the converter may deliver digital values of the samples in the form of 8-bit words, one bit being reserved for the sign of the sample.

The device also comprises an assembly of digital circuits 30 and a microprocessor 40. The digital processing circuits are connected, on the one hand, to the output of the analog-digital converter and to the clock output H and, on the other hand, to the microprocessor. These circuits are more precisely: an accumulator 31 for adding the values of the successive samples which are supplied to its multiple signal input in the form of 8-bit words by the converter; the sums are supplied in the form of 12-bit words of which only the 8 of highest weight are transferred to the microprocessor 40 to be stored. A zero detector 32 whose signal input receives the bit characteristic of the sign of the samples supplied by the converter. This zero crossover detection circuit is a simple logic circuit which compares the sign of the sample present at the output of the converter with the sign of the preceding sample stored in this circuit. This detector has an output which supplies an interruption pulse $I_e$ to microprocessor 40. The zero detector also comprises a clock input H. The digital processing circuits also comprise a counter 33 having an input connected to the output H of divider 2 and a reset input, RAZ; this counter allows measurements of the time elapsed between two resets to be given to the microprocessor. Finally, these circuits 30 also comprise a frame counter 34 whose input is also connected to the output H of divider 2 and whose output supplies interruption pulses $I_s$ to the microprocessor, for the display and the storage of the results obtained during a test procedure; this circuit also has a reset input, RAZ.

Microprocessor 40 comprises: a processing unit MPU, 41; a random access memory RAM, 44, whose contents may be modified and read at will, and which allows the values of sums $a_i$ and time intervals $t_i$ to be stored as well as the intermediate values useful to the detection; a read-only memory, PROM, 45 in which the test program for determining the melody frequency is registered; a display device 46 displaying, when required, the detected values. These elements 41 to 46 are connected together and to an interface circuit PIA, 42 via a bidirectional connection bus 47, the interface circuit also being connected by bidirectional data buses 35, 36, 37 to the accumulator 31 and to counters 33 and 34. The bus address and the address decoders have not been shown in this diagram for the sake of simplicity.

The acquisition of data from the filtered and sampled signal is obtained by means of the digital processing circuits in connection with the microprocessor in the following way.

As pointed out above, an interruption pulse $I_e$ supplied by the zero crossover detector 32 to the interface circuit 42 controls the transfer of the contents $a_i$ of accumulator 31 into a first table of memory 44 (through the connection bus 35 between the accumulator and the interface circuit 42, interface circuit 42 and the connection bus 47 between the interface circuit and memory 44), and the transfer of the contents $t_i$ of counter 33 into a second table of memory 44 (through connection bus 36, interface 42, and connection bus 47).

After these transfers, interface circuit 42 controls the resetting of accumulator 31 and of counter 33. The test procedure takes place in real time, which allows the size of the RAM required to be limited, the two tables each comprising, for example, 256 memory cells, and the new data being written in over the old data already tested. For that, reading and writing indices for these tables are provided and an additional test, not detailed here, ensures during reading that the reading index does not overrun the writing index (so as not to use again the values already tested) and during writing that the writing index does not overrun the reading index (which would cause nontested values to be lost).

The test procedure used from this data takes into account the shape of the speech signal and develops from a test program recorded in the program memory 45. The test procedure characteristic of the process for detecting the melody frequency will be explained in detail hereafter with reference to the signal diagrams of FIGS. 2, 3, 4 and 9 and to the sequential diagrams of the test program shown in FIGS. 5 to 8.

Figure 2:
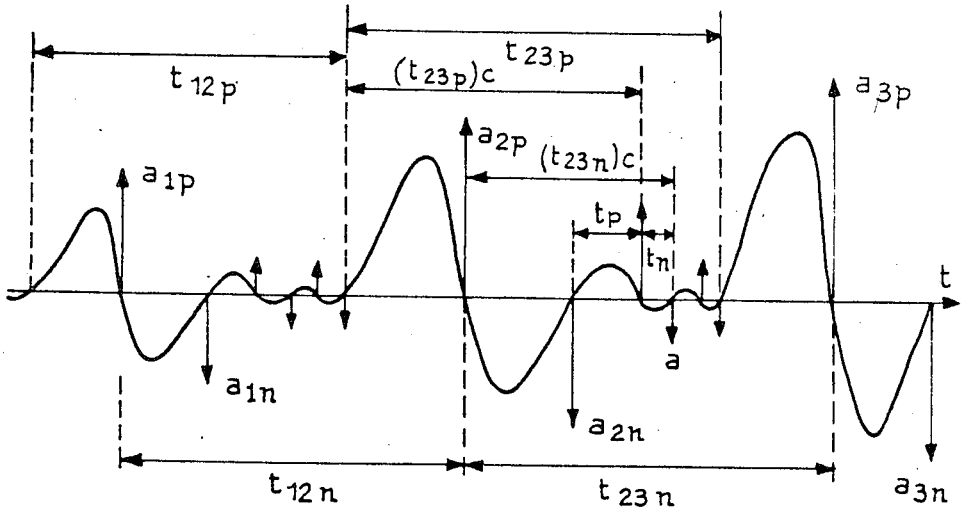
FIG. 2 shows one example of a voiced signal segment, at the beginning of speech.

FIG. 2 shows an example of a voiced signal segment at the beginning of speech. This signal is formed of positive and negative half-waves whose maximum amplitude, duration and energy are variable. The voiced signal is characterized by the fact that two successive half-waves (of different signs) having energies greater than those of the preceding and following half-waves of the same sign, may be detected in this signal. These particular half-waves are repeated at a practically constant period, so-called melody period.

Generally, the detection process of the invention consists:

for the acquisition phase of the voiced signal, in detecting three groups of two successive half-waves, whose energies ($a_{1p}$ and $a_{1n}$, $a_{2p}$ and $a_{2n}$, $a_{3p}$ and $a_{3n}$) and the configuration in time correspond to a set of criteria; when these criteria are verified, the voiced character of the signal is acquired, three pitch period commencements having been found, and a first value of the pitch period is calculated;

for holding the voiced character under test, it is verified that half-waves having energies exceeding specific thresholds depending on the energy values of the preceding half-waves selected are present in the signal at time intervals close to the initial melody period calculated; the value of this period is then updated.

When the holding tests of the voiced character is not verified, a new acquisition procedure is initiated.

An "atest" pointer is provided for switching in the different elementary tests, the state of this register being characteristic of the progress of the detection:

atest=0: beginning of the acquisition phase; no test is verified;

atest=1: the first half-wave capable of characterizing the commencement of the first voiced period is selected;

atest=2: the half-wave succeeding the first voiced period is selected;

atest=3: the first half-wave capable of characterizing the commencement of the second voiced period is selected;

atest=4: the half-wave succeeding the second voiced period is selected;

atest=5: the first half-wave capable of forming the commencement of the third voiced period is selected;

atest=6: the half-wave succeeding the third voiced period is selected;

atest=7: the first half-wave capable of forming the beginning of an $n^{th}$ voiced period is selected;

atest=8: the second half-wave of the $n^{th}$ voiced period is selected.

Before being able to carry out a first measurement of the pitch period, the first test enables two successive half-waves of opposite signs to be found, whose energies exceed given thresholds, $S_{1p}$ and $S_{1n}$, the beginning of the first of these two half-waves being able to form the beginning of the melody period when the following tests are also verified.

Figure 5:
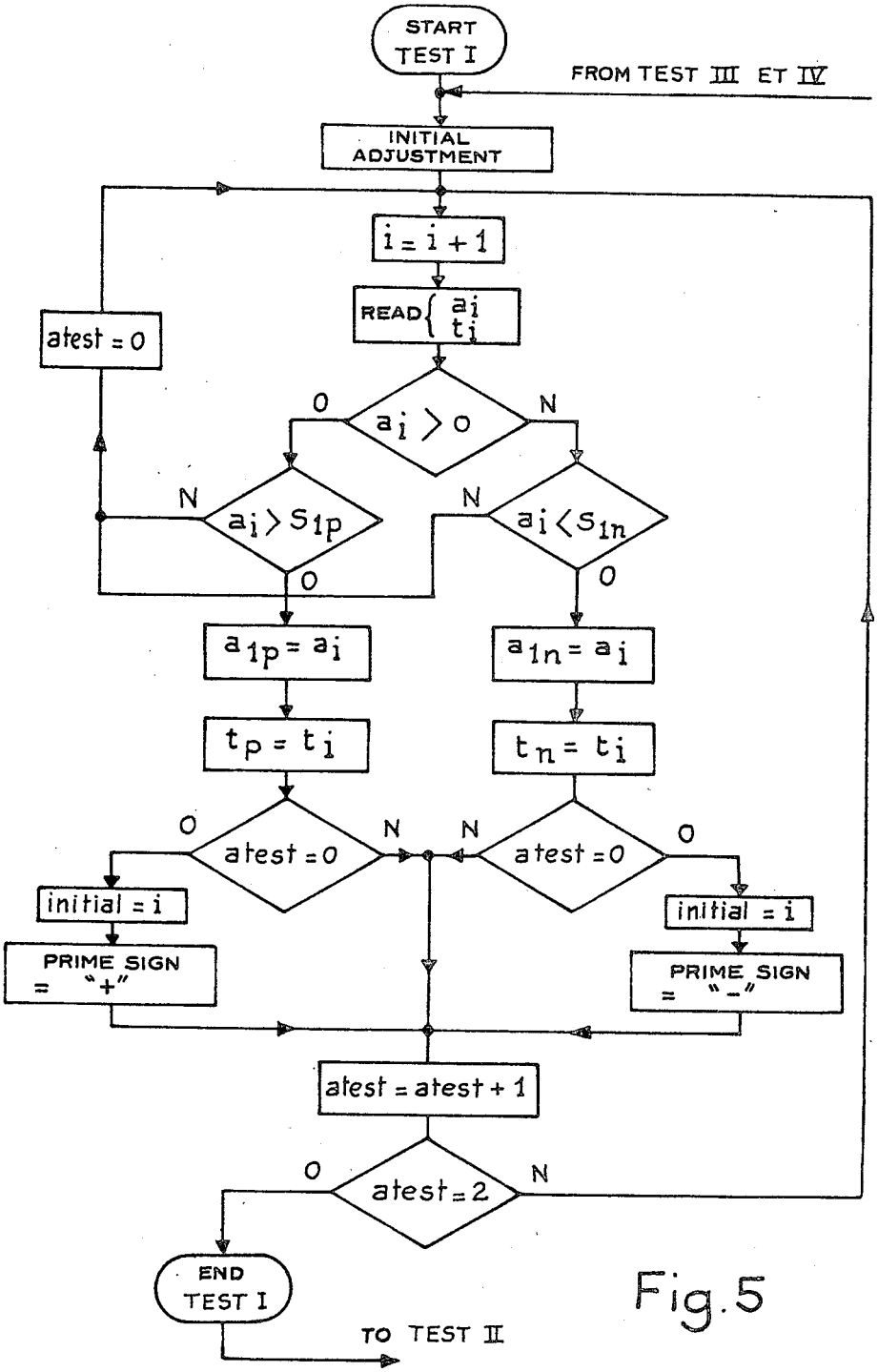
FIGS. 5, 6, 7 and 8 show sequential diagrams of the different phases of the process for detecting the pitch frequency.

The flow chart of the corresponding test program is shown in FIG. 5, this test being designated by test I hereafter. After a phase for adjusting all the variables, the reading index of the tables of memory 44, i, is incremented. Then a sum $a_i$ and the corresponding time interval $t_i$ are read from the memory. A test on the sign of the sum $a_i$ then allows the value of the sum $a_i$ to be tested with respect to the above-defined thresholds, $S_{1p}$ and $S_{1n}$. When this test is negative, the "atest" pointer is reset. A new reading of the variables is then undertaken. When one of these tests is positive, the corresponding value of the sum $a_i$ is loaded into a register and forms the value $a_{1p}$ or $a_{1n}$, depending on the sign of the sum, which value is capable of forming the first sum of a melody period commencement. The value of the corresponding time intervel $t_i$ is loaded into a register and forms a value $t_p$ or $t_n$, depending on the positive or negative sign of the corresponding sum. This signal is furthermore stored in a "prime sign" register so as to search subsequently for the beginning of the following periods only on sums of the same sign. Moreover, the value of the reading index, i, is also stored in an "initial" register so as to be possibly used subsequently. When this first sum is detected, the "atest" pointer, initially at zero, is incremented by 1. A test on the value of this point with respect to 2 is then initiated before searching for the following sum for completely characterizing the beginning of the melody period. This second sum must exceed the corresponding sign threshold. If it does not exceed the threshold, atest is brought back to zero and the test is resumed with the following sum. When this second sum of opposite sign is also found, the "atest" pointer is again incremented and the test of the value of this pointer with respect to 2 is then verified. The first two values $a_{1p}$ and $a_{1n}$, greater than thresholds $S_{1p}$ and $S_{1n}$, are then found.

The test procedure continues then so as to search for the beginning of the second melody period, at the same time as the time intervals between zero crossovers are added so as to allow a value of the pitch period to be subsequently determined.

Figure 6:
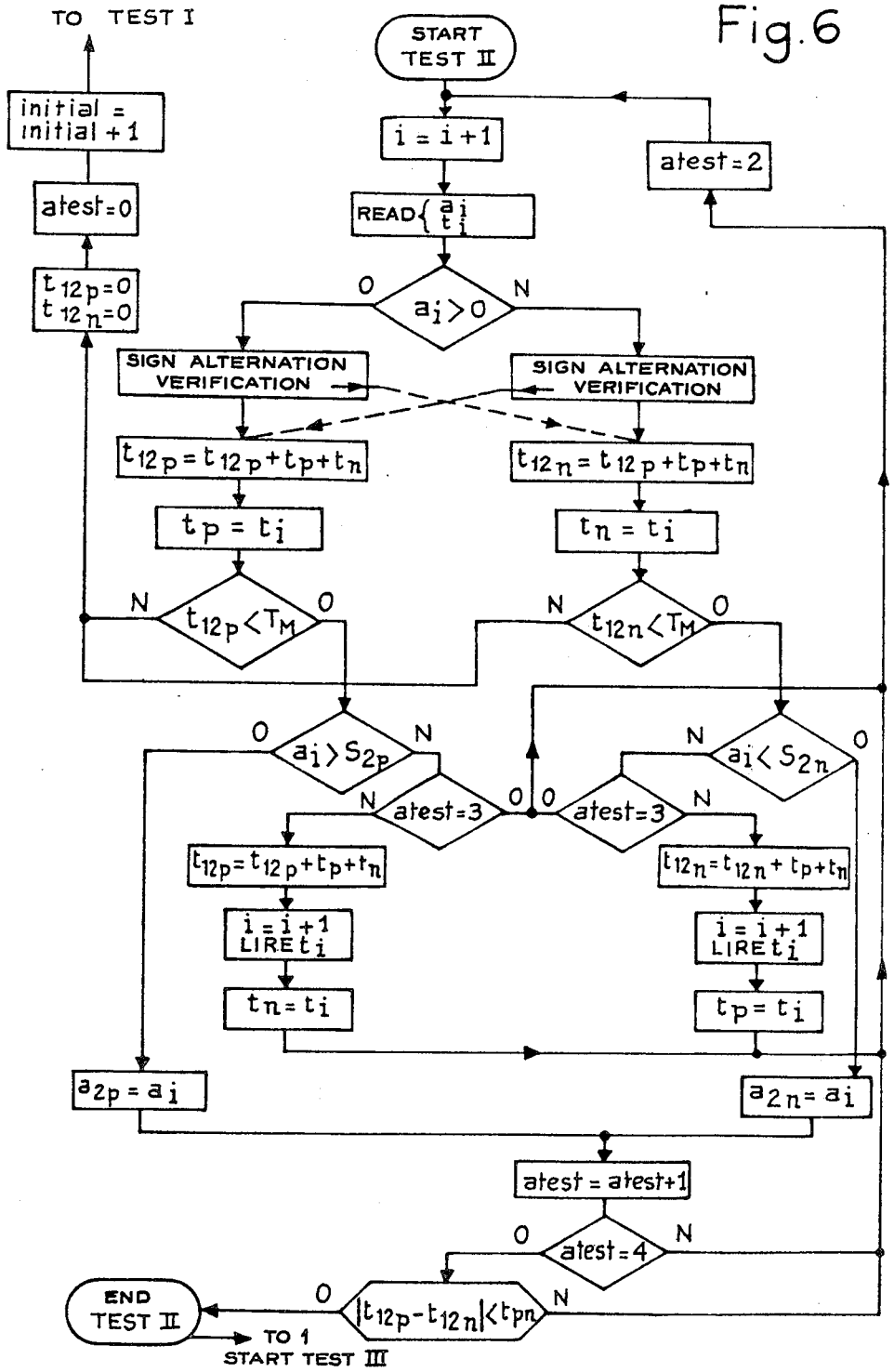

FIG. 6 shows the test procedure for determining the beginning of this second period and the first time interval values between the sums selected having the same sign of the first two groups. As before, the reading index is first of all incremented, then a sum and a corresponding time interval, $a_i$ and $t_i$, are read in the memory. The sign of the sum $a_i$ is tested and two parallel branches are possible depending on the sign of the sum. At the beginning of each branch, a verification of the alternation of the sign of the sums is carried out. When this condition of alternation is not verified, the branch may be changed by switching after correction of the overflow. These changes of branches are shown in dotted lines in the figure. When the condition of alternation is indeed verified, the so-called "current" time interval, $t_{12p}$ or $t_{12n}$ between the sum of the first group, $a_{1n}$ or $a_{1p}$ having the same sign as the sum $a_i$ under test and the beginning of the alternation corresponding to this sum under test is calculated in the following way: $t_{12p}$ new value is equal to $t_{12p}$ old value plus $t_p$ plus $t_n$. Then the value of the time interval between zero crossovers, $t_i$, corresponding to this sum under test is stored in a register ($t_p$ or $t_n$ depending on its sign) which allows the current time interval to be calculated.

The value of this current time interval, either $t_{12p}$ or $t_{12n}$, is then compared with the maximum value $T_M$ of the melody period; this value $T_M$ being a prerecorded data.

When this current time interval is greater than $T_M$, the first half-waves selected, corresponding to the sums $a_{1p}$ and $a_{1n}$, could not correspond to the beginning of a pitch period and the program is reswitched towards the first test, after reinitialization of the current time values and of the "atest" variable, and incrementation of the value of the "initial" register stored in memory.

On the other hand, when the current time value does not exceed the maximum period $T_M$, the value of the corresponding sum $a_i$ is compared to a threshold depending on the value of the first sum selected having the same sign.

In fact, the sums of the second group for characterizing the beginning of the second period have values situated close to the values of the first sums selected. In the example shown, the test is carried out with respect to threshold values:

$$S_{2p}=\max\{\tfrac{3}{4}a_{1p}; S_{1p}\};$$

$$S_{2n}=\min\{\tfrac{3}{4}a_{1n}; S_{1n}\};$$

that is to say that these threshold values are equal to the highest, in absolute value, of the two values $\frac{3}{4}a_{1p}$ and $S_{1p}$ for the first one, and $\frac{3}{4}a_{1n}$ and $S_{1n}$ for the second one:

When the result of this test is negative, a test on the value of the "atest" pointer is carried out, so as to increment the reading index i and to calculate directly the value of the current time without effecting any test on the following value of the sum; in fact, this following sum cannot form the beginning of the second period considering its sign (atest is then equal to 2).

On the other hand, whether the result of the test on the value of the sum is positive, the value of the corresponding sum may constitute the first sum $a_{2p}$ or $a_{2n}$ of the second group, corresponding to the beginning of the second period, and the "atest" variable is incremented. Only the first one of the two sums has been found and a test of the "atest" pointer with respect to "4" enables a new test procedure to be initiated since, at that time, atest=3. The same tests on the following value permit either the same criteria to be verified, except for the sign, on the following sum, or a return to the beginning of test I after reinitialization when the criterion of duration with respect to the maximum period is not verified or to the beginning of test II when the criterion of duration is verified but not the criterion on the value of the sum. Then atest is brought back to value 2 for the preceding sum selected cannot constitute the beginning of the second period since the following sum cannot be selected.

When the two successive values have been found, the "atest" pointer, which is again incremented, has then the value four; which indicates that the second test is ended. A last comparison of the difference between the current time value $t_{12p}$ and the current time value $t_{12n}$ (each of these two variables being able to give a value of the melody period) allows a verification to be made that this difference is less than a given time deviation, $t_{pn}$; with this test it can be ascertained whether the signal is sufficiently regular for a pitch period to be able to be characterized and the evident errors eliminated. $t_{pn}$ may be chosen equal to 256 microseconds (i.e. 20 samples at 7.8 kHz). This divergence between $t_{12p}$ and $t_{12n}$ is also the divergence between the first half-waves of the two groups selected.

Test II is then terminated and test III, for searching for the beginning of the third voiced period, may then begin.

Figure 7:
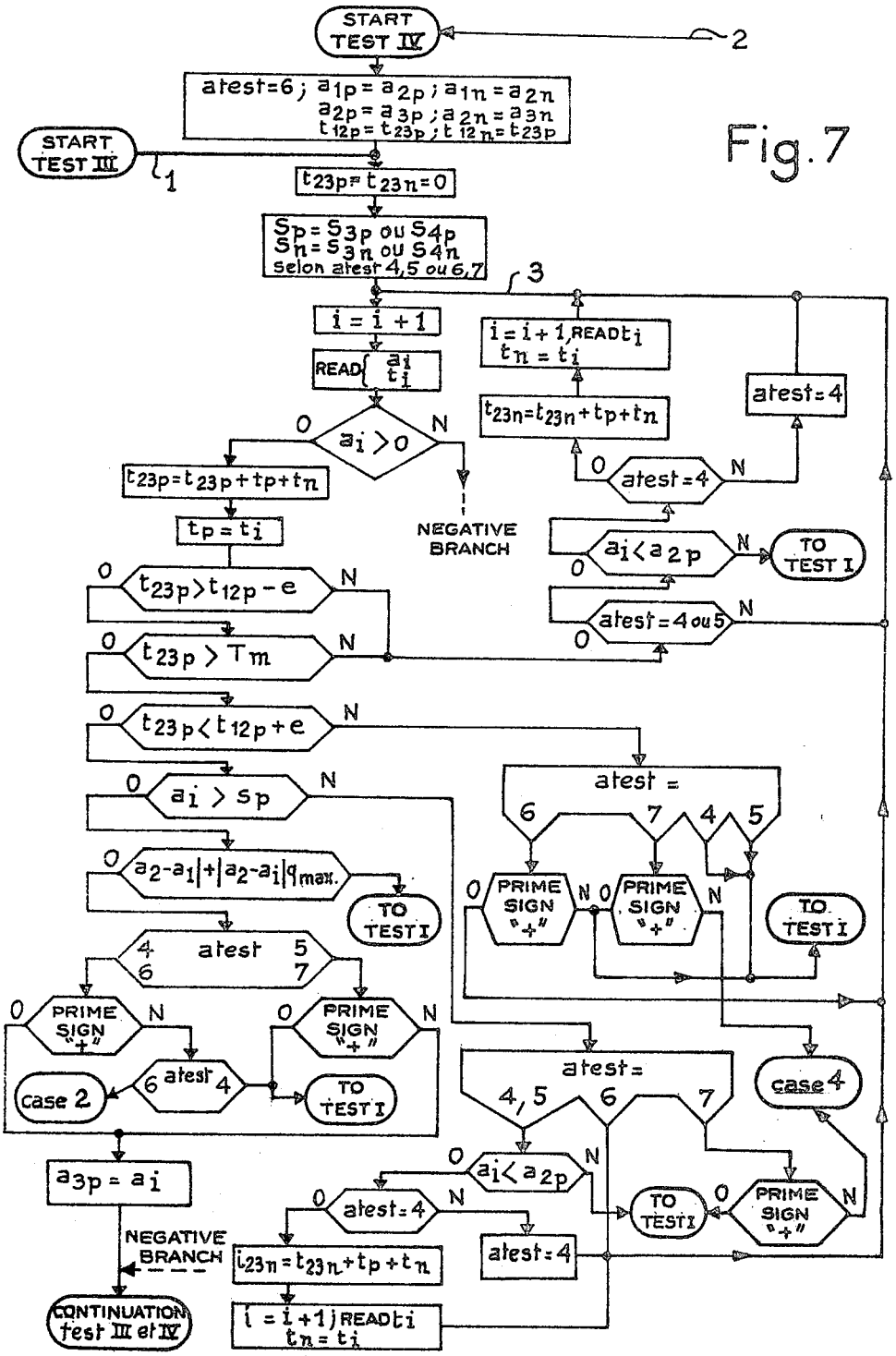
Figure 8:
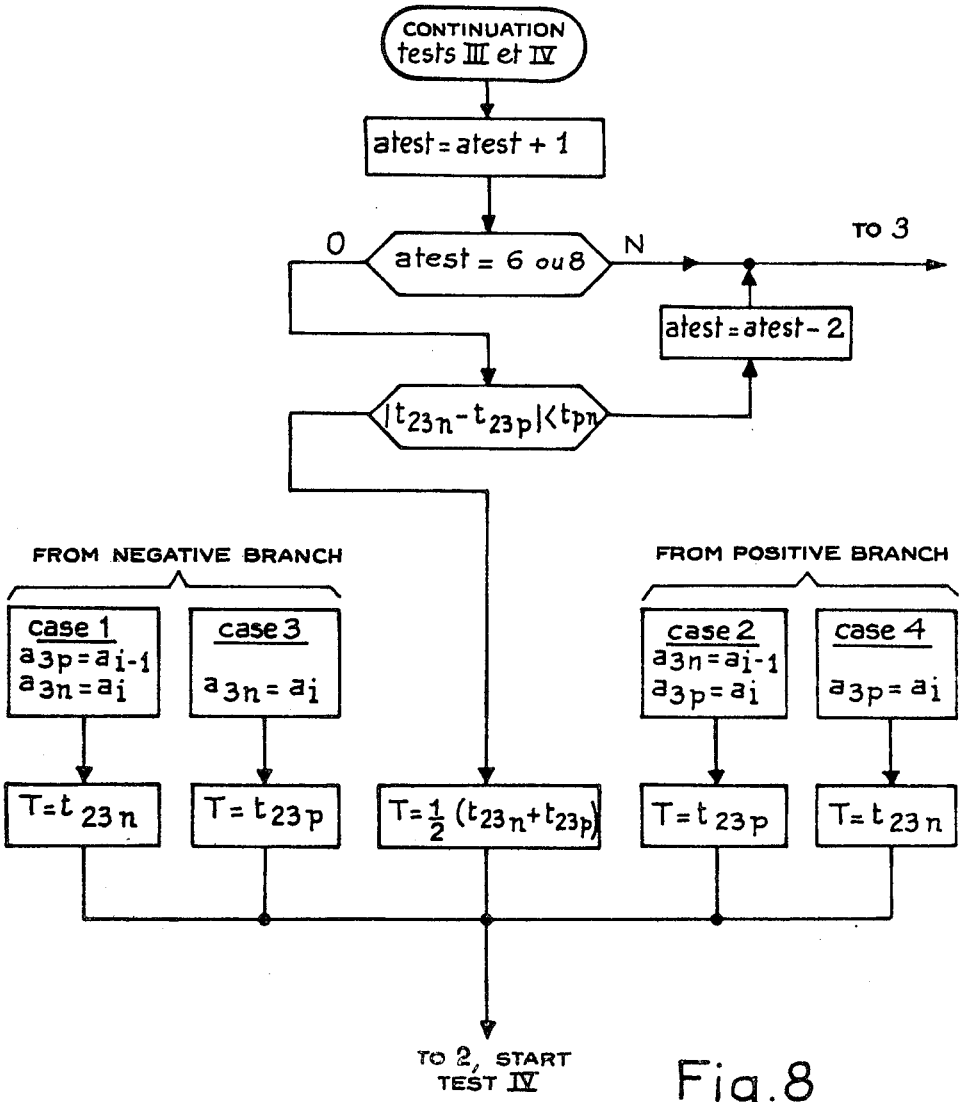

FIG. 7 and FIG. 8 show test III which, from the first and second groups of sums selected, enables the third group of sums to be searched for which may characterize this beginning of the third period; the acquisition of the set of values of sums selected and the corresponding time interval values indicates that the voiced character of the signal is acquired and then allows a value of the pitch period to be calculated which takes into account the time intervals between period beginnings.

Before describing test III, the different tests which are carried out therein are presented herebelow.

As for the first two tests, the values of sums $a_i$ are compared with threshold values; these threshold values $S_{3p}$ and $S_{3n}$ depend on the preceding sums of the same sign selected in the following way:

$$S_{3p}=13/16\,[a_{2p}+(a_{2p}-a_{1p})]$$

$$S_{3n}=13/16\,[a_{2n}+(a_{2n}-a_{1n})]$$

Moreover, as in the first two tests, the current time intervals (between the sum selected of the same sign characterizing the beginning of the second period and the sum under test), $t_{23p}$ and $t_{23n}$, are compared with values of duration defined in the following way:

$$\begin{cases} t_{23} > t_{12-e} & (1) \\ t_{23} > T_m & (2) \\ t_{23} < t_{12+e} & (3) \end{cases}$$

$T_m$ characterizing a minimum melody period and e a tolerated maximum time deviation are prerecorded data. The first two tests, (1) and (2) on the current time value, enable a verification to be made that the current time is long enough to be able to constitute a melody period. The third is on the contrary for making sure that this current time value is not too great.

Figure 3:
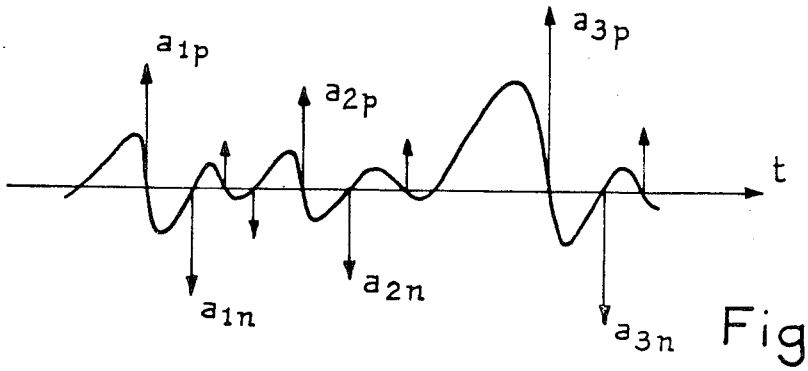
FIGS. 3 and 4 show other examples of voiced signal segments, at the beginning of speech, which risk leading to false detections.

An additional monotony condition in the progression of the sums is also required so as to avoid detecting the half-period. FIG. 3 shows a voiced signal segment which, if this additional condition were not imposed, would lead to a double frequency detection by selecting the sums indicated $a_{1p}$ and $a_{1n}$, $a_{2p}$ and $a_{2n}$, and $a_{3p}$ and $a_{3n}$, whereas $a_{2p}$ and $a_{2n}$ correspond to half-waves in the middle of the melody period. This condition of monotony is:

$$|a_2-a_1|+|a_2-a_3|\leqq q_{max}$$

$q_{max}$ being a prerecorded data, indices p or n being added to the sums $a_1$, $a_2$ and $a_3$ depending on the branch of the test in progress.

Figure 4:
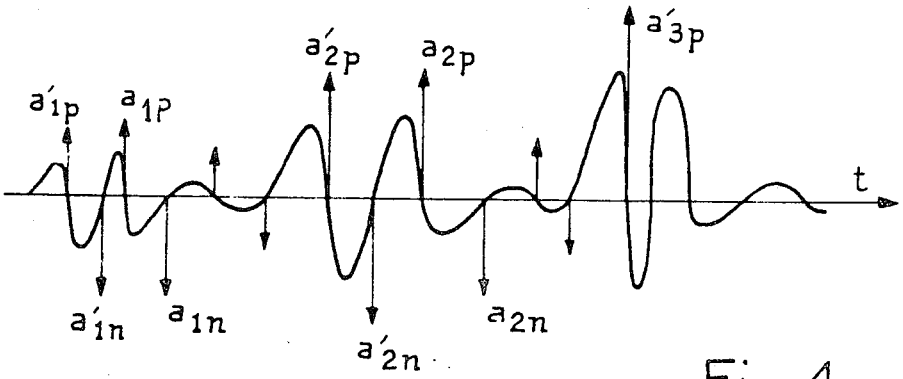

Furthermore, so as to guard against acquisition errors likely to occur in a voiced signal configuration such as the one shown in FIG. 4, where the middles of periods are selected instead of the beginnings of periods (which may lead to a loss of synchronization in the middle of the voiced segment or to the subsequent detection of half-periods, double melody frequency), another additional condition is imposed: this condition is that values of sums $a_i$ rejected are not greater than the preceding sums of the same sign selected. For the voiced segment shown in FIG. 4, $a_{1p}$, $a_{2p}$ and $a_{1n}$, $a_{2n}$ would be normally selected, but the above described condition implemented in test III will not be verified for $a'_{3p}$ rejected by the criteria of duration is greater than $a_{2p}$ selected. In this case, it is the values a' which correspond to the period beginnings and should have been selected, and the whole of the search is restarted from the beginning of test I.

The flow of the test III program is shown in FIGS. 7 and 8. These figures also show the flow of test IV used when the voiced character of the signal is acquired in order to verify that the voiced character is maintained. In fact, the sequences corresponding to the third test, test III, and to the fourth test, test IV, only differ by internal branches which depend on the value of the "atest" pointer, and by the threshold values with which the sums $a_i$ under test are compared. These threshold values and the corresponding test are defined in the following way:

$$\begin{cases} S_{4p} = \max\{\tfrac{3}{4}\,[a_2 + (a_{2p} - a_{1p})];\ S_{1p}\} \\ S_{4n} = \min\{\tfrac{3}{4}\,[a_{2n} + (a_{2n} - a_{1n})];\ S_{1n}\} \end{cases}$$

These conditions are close to those of test III but the tolerance on the thresholds is wider ($\frac{3}{4}$ and not 13/16). Furthermore, these thresholds which might become too low or even change sign at the end of a voiced segment are bounded by the predetermined thresholds $S_{1p}$ and $S_{1n}$. Finally, and especially, when a single one of these conditions is verified, the voiced character of the signal continues to be considered as acquired provided that the conditions concerning the time intervals are verified. In fact, if this arrangement were not adopted, a reduction of energy in a single one of the half-waves of the voiced signal could lead to deciding that the voiced character is lost, or to be detecting a double pitch period whereas the presence of the sum of the opposite sign is sufficient to maintain a correct decision. The tests concerning the time intervals are exactly the same as those used in test III.

Some branches of the sequence are common to tests III and IV. Moreover, those which, after testing the "atest" pointer, correspond to atest=4 or 5 are test branches III and those which correspond to atest=6 or 7 are test IV branches. To simplify the figures, only the branches relative to the positive sums have been shown. Symmetrical nondetailed negative branches correspond to the detailed positive branches in these figures. They only differ by the index of the variables and the thresholds (n instead of p and the direction of comparison for the test with respect to the threshold).

The diagram shown comprises a first input 1, beginning of test III, when the voiced character is not acquired; another input 2, beginning of test IV, enables, when the voiced character is acquired, the test variables to be reinitialized and the preceding values selected $a_2$, $a_3$ and $t_{23}$ to be updated to $a_1$, $a_2$ and $t_{12}$ (for the positive and negative values) when the search advances by one period. This shift appears in FIG. 9 which shows a voiced signal segment tested during a holding phase (the old values are in brackets above the new values). Then a branch common to test III and test IV, the reading index, is incremented; the sum $a_i$ and the time interval $t_i$ are read from the memory. A test on the sign of the sum enables the branch of the suitable test procedure to be chosen. In what follows, it is assumed that the first sum selected in test I is positive, i.e. that the first sum tested in test III is also positive. The current time interval $t_{23p}$ is calculated and this time interval is tested.

If this interval is too short to be able to correspond to a melody period ($t_{23p}<t_{12p}-e$ or $t_{23p}<t_{min}$) and if the sum under test is nevertheless greater than $a_{2p}$, the first two sums selected were wrong (FIG. 4) and the whole search is reinitialized from test I, for the voiced character was not acquired (atest=4). On the other hand, if this sum is not greater than $a_{2p}$, which is the normal case, the current time is updated and the reading index is incremented for reading a time value $t_i$, stored in the register for calculating the current time, and the current time is calculated. Then the test is restarted at the level of the first reading index incrementation (point 3), which enables the next half-wave of the same sign to be tested.

If the time interval $t_{23p}$ is not too short but, on the contrary, if it exceeds value $t_{12p}+e$, all the variables are reinitialized and the search is started again from test I for the beginning of the third period has not been found.

If the time interval $t_{23p}$ is not too short and if, at the same time, it does not exceed value $t_{12p}+e$, this interval may correspond to the pitch period. Consequently, the test on the value of the sum with respect to the threshold $S_p$ ($S_{3p}$ in this test III) is carried out. If this test is not verified, the value of the current time is updated, the reading index is incremented and the time interval $t_i$ which corresponds thereto is stored in memory. The test of the following half-wave having the same sign is undertaken by returning to point 3 of the test.

When the sum $a_i$ is greater than the threshold, the first sum $a_3$ of the third period ($a_{3p}$ in the example shown, "prime sign" being positive) is found providing that the monotony criterion between the values $a_1$, $a_2$ and $a_3$ mentioned above is also verified. Then $a_{3p}=a_i$. If not the test is started again from the beginning of test I.

The atest value is then incremented (atest=5) (FIG. 8), then this atest value is compared with 6 and 8. Since test III is not finished, this test is negative. By taking up test III again at point 3, it remains to be verified by the other branch (BR NEG in the example shown) that the energy in the next half-wave also exceeds the threshold which is associated therewith for this sum to be selected as the second one of the third period. For that, the same tests on the time interval are effected. When this interval ($t_{23n}$ in the example shown) is too short and when the sum $a_i$ under test is greater than $a_{2n}$, the whole search is reinitialized from test I, for the voiced character was not acquired (atest=5). On the other hand, if this sum is not greater than $a_{2n}$, the current time is updated, the atest value is brought back to 4 and test III is taken up again at point 3 on the following sum to begin again the search for the beginning of the third period.

If the time interval ($t_{23n}$) exceeds the maximum value, the search is reinitialized from test I. Similarly, if the value under test does not exceed the corresponding threshold $S_{3n}$ (as at the time of a failure on the first two duration tests) the current time is calculated, the time interval $t_i$ is stored in memory and atest is brought back to 4 so as to cancel out the preceding sum selected and to begin again the search for the beginning of the third period. After the test of the monotony criterion (return to the beginning of test I if this criterion is not verified), atest being equal to 5, a "prime sign" test is effected. With this test it can be ascertained that the value at the point to be selected ($a_{3n}$ in the example shown) is of the opposite sign with respect to the first sum selected.

Then, as previously, the atest pointer is incremented and atest is then equal to 6. The second half-wave of the third period is found. The same criterion as in test II concerning the difference of the periods beginning at half-waves of opposite signs is then verified so as to eliminate the evident errors: $|t_{23n}=t_{23p}|<t_{pn}-(4)$. If this condition is verified, the value of the melody period is calculated:

$$T=\tfrac{1}{2}(t_{23n}+t_{23p}).$$

A new test, which is then the fourth test, is carried out (by switching to input point 2, beginning of test IV) so as to find out whether the voiced character of the signal is maintained.

If the condition (4) concerning the time intervals is not verified, the atest value is reduced by 2 and the test is started again at point 3.

For the fourth test, the basic procedure is similar to that of the third test but additional branches are provided so that particular signal configurations which do not satisfy all the above-mentioned conditions (which should lead for test III to final rejection of the half-wave considered) are interpreted as voiced signal when the voiced character was previously acquired. These particular configurations are shown in FIG. 10. They are such that one of the half-waves of the beginning of the $n^{th}$ period, the first or the second, which may be positive or negative, has an energy less than the fixed threshold $S_{4p}$ or $S_{4n}$, the other exeeding the corresponding threshold. For each of these configurations, the values of the different variables used for the flow of the procedure are given in FIG. 10 beside the corresponding configuration.

When, with atest equal to 6, the sign of the sum selected does not correspond to that expected, the test procedure is such that "case 1" and "case 2" correction branches provide an outlet from test IV—while retaining the preceding sum rejected $a_{i-1}$ and while calculating normally the period.

When, with atest equal to 7, the sign of the sum under test is that expected but when this sum is less than the threshold or when, the atest equal to 7, the current time interval has become too large, only the first sum of the $n^{th}$ period (respectively $a_{3p}$ and $a_{3n}$ for cases 3 and 4) is selected and the pitch period is then equal to the corresponding time interval, $t_{23p}$ or $t_{23n}$. These corrections are very important for these particular configurations frequently occur and, if they were not taken into account, would lead to a double period detection.

The voiced-unvoiced decision is affected directly from the result of the test, by the value of the period. When the decision is requested at a timing different from that of the test, at the frame timing (given the frame counter 34) by means of the output interruption pulses $I_S$ applied to microprocessor 40, the value of the period, resulting from the test procedure, may be corrected by calculating a mean value. In fact, the measurement of the value of the pitch period may be given in real time or with a lag of a frame, an output register being provided for storing the current value of the melody period at suitably chosen times. When, during the test procedure, test III or test IV fails, or when no zero crossover is detected during the frame, this output register is reset.

However the voiced-unvoiced decision logic may be a little more elaborate: for example, an additional duration criterion is introduced so that a voiced segment is always greater than 25 mS for example. Similarly, a segment for which the detection procedure might indicate the unvoiced character but the duration of which might be less than 25 mS is masked by the insertion of pitch values interpolated from those evaluated on the adjacent voiced segments.

The above-described procedure for detecting the melody frequency may be carried out with a microprocessor of modest performance. It has been implemented, during research and development work, on a ROCKWELL, AIM 65 microcomputer, built around an MPU 6502 microprocessor.

The test procedure described above by way of example and the detection device which is associated therewith may be modified without for all that departing from the scope of the invention.

For example, the device shown in FIG. 1 comprises an interface circuit 42. It is also possible to use two PIA interface circuits for allowing, if need be, additional interruptions to be effected and several methods of execution to be introduced, continuous method of execution in real time for a system in operation, or launched execution for a certain number of frames when the processing is effected on recorded data.

Furthermore, the flow charts of the above-described test procedures may be modified, for example by modifying the order of the elementary tests when that is possible, without departing from the scope of the invention. In addition, the threshold values indicated above by way of example may also be chosen, for example, depending on the type of voice (men's voices and women's voices).

What is claimed is:

1. A process for detecting, in real time, the pitch frequency of a speech signal, comprising the steps of:

measuring a reduced set of data of said signal with said set comprising values of the energy in successive half-waves of said signal and values of the duration of said half-wave;

performing a procedure on said set of data with said procedure including an alternate acquisition phase for performing a first series of test whereby said energy values are compared with a first at least one predetermined value in order to confer an acquired character on said speech signal whenever said first at least one predetermined value is exceeded, and which then calculates a pitch period value, and wherein said procedure further involves a holding phase for performing a second series of tests whereby said energy values which exceed said first at least one predetermined value are compared with a second at least one predetermined value in order to update said pitch period value;

repeating said second series of tests as long as said second at least one predetermined value is exceeded thereby maintaining said acquired character; and initiating a new acquisition phase when said acquired character is lost because said second at least one predetermined value has not been exceeded.

2. The detection process as claimed in claim 1, wherein the first series of tests consists in selecting in the succession of the measurements of energy in the successive half-waves of the signal, $a_i$, three groups of two successive measurements $a_{1p}-a_{1n}$, $a_{2p}-a_{2n}$, $a_{3p}-a_{3n}$ exceeding predetermined thresholds $S_{1p}$ and $S_{1n}$ for the first group and thresholds $S_{2p}$ and $S_{2n}$, $S_{3p}$ and $S_{3n}$ defined as a function of the energies in the preceding selected half-waves for the following groups, the time intervals between selected half-waves of the same sign, calculated from the durations $t_i$ of the half-waves, complying with defined criteria, these three half-wave groups characterizing the beginnings of three successive melody periods.

3. The detection process as claimed in claim 2, wherein the thresholds $S_{2p}$ and $S_{2n}$ are defined as being the highest value of $\frac{3}{4}a_{1p}$ and of $S_{1p}$ for the first and of $\frac{3}{4}a_{1n}$ and $S_{1n}$ for the second.

4. The detection process as claimed in claim 3, wherein the thresholds $S_{3p}$ and $S_{3n}$ are defined by the relationships:

$$S_{3p}=13/16\ [a_{2p}+(a_{1p}-a_{1p})]$$

and $$S_{3n}=13/16\ [a_{2n}+(a_{2n}-a_{1n})]$$

5. The detection process as claimed in any one of claims 2 to 4, wherein the second series of tests consists in selecting, in the succession $a_i$ of measurements of energy in the successive half-waves, two successive measurements one at least of which exceeds the threshold $S_{4p}$ or $S_{4n}$, according to the sign of the corresponding half-wave, these thresholds $S_{4p}$ and $S_{4n}$ defined as a function of the energies in the preceding selected half-waves limiting wider areas with respect to the preceding selected values than those defined by thresholds $S_{3p}$ and $S_{3n}$ used in the first series of test, the time intervals between selected half-waves of the same sign, calculated from the durations $t_i$ of the half-waves, complying with defined criteria, these selected half-waves characterizing the beginning of an $n^{th}$ melody period.

6. The detection process as claimed in claim 5, wherein the thresholds $S_{4p}$ and $S_{4n}$ are defined as being the greatest value of $\frac{3}{4}[a_{2p}+(a_{2p}-a_{1p})]$ and of $S_{1p}$ for the first and of $\frac{3}{4}[a_{2n}+(a_{2n}-a_{1n})]$ and of $S_{1n}$ for the second.

7. The detection process as claimed in claim 2, wherein, in addition to the threshold criteria concerning the energy measurements, a criterion of monotony in the variation of these energy measurements in the selected half-waves is also verified in the series of tests to as to avoid detection of the double frequency of the real melody frequency.

8. The detection process as claimed in claim 1, wherein protection tests are provided in the first and in the second series of tests so as to reject half-waves which cannot characterize the beginning of a new melody period because of their position in time with respect to the preceding selected half-waves.

9. The detection process as claimed in claim 1, wherein, at the end of the first series of tests, a test on the energy measurements rejected with respect to the energy in the preceding selected half-wave of the same sign is carried out, so as to avoid initialization of the melody period during the acquisition phase in progress and not at the beginning of the period.

10. The detection process as claimed in claim 1, wherein the step of measuring a reduced set of data is accomplished through the use of an analog processing circuit having an amplifier and a low pass filter with the input to said analog processing circuit receiving said speech signal and the output being connected to an analog-digital converter and wherein the output of said analog-digital converter is fed to a digital processing circuit and provides to said processing circuit said values of the energy in successive half-waves of said signal and values of the duration of said half-waves, and wherein said digital processing circuits are controlled by a microprocessor to store said values of energy and said values of duration and wherein said microprocessor performs said procedure on said set of data in accordance with a programmable memory with an interface circuit providing the data transfer between said microprocessor and said digital processing circuits.

* * * * *